US007836831B2

(12) United States Patent
Eger et al.

(10) Patent No.: US 7,836,831 B2
(45) Date of Patent: Nov. 23, 2010

(54) COUPLING MUFF CONNECTION COMPRISING A THREE-PART ADAPTER SUPPORTING PLATE

(75) Inventors: Clemens Eger, Vienna (AT); Georg Fleischmann, Vienna (AT)

(73) Assignee: Siemens AG Oesterreich, Vienna (AT)

( * ) Notice: Subject to any disclaimer, the term of this patent is extended or adjusted under 35 U.S.C. 154(b) by 498 days.

(21) Appl. No.: 11/631,924

(22) PCT Filed: Jun. 28, 2005

(86) PCT No.: PCT/AT2005/000239

§ 371 (c)(1),
(2), (4) Date: May 13, 2008

(87) PCT Pub. No.: WO2006/002448

PCT Pub. Date: Jan. 12, 2006

(65) Prior Publication Data

US 2009/0114116 A1 May 7, 2009

(30) Foreign Application Priority Data

Jul. 6, 2004 (AT) ..... A 1141/2004

(51) Int. Cl.

| | |
|---|---|
| ***B60D 5/00*** | (2006.01) |
| ***B61D 15/06*** | (2006.01) |
| ***B61D 17/00*** | (2006.01) |
| ***B61D 17/14*** | (2006.01) |

(52) U.S. Cl. ..... 105/8.1; 105/15; 105/392.5; 105/413

(58) Field of Classification Search ..... 105/3, 105/4.1, 4.2, 8.1–22, 392.5, 413; 213/75 R, 213/77, 109; 280/403

See application file for complete search history.

(56) References Cited

U.S. PATENT DOCUMENTS

| | | | | |
|---|---|---|---|---|
| 2,081,964 | A * | 6/1937 | Tomlinson | 105/21 |
| 2,843,417 | A * | 7/1958 | Wahl et al. | 280/403 |
| 4,736,688 | A * | 4/1988 | Ando et al. | 105/17 |
| 4,798,148 | A | 1/1989 | Girard | |
| 7,506,590 | B2 * | 3/2009 | Moser et al. | 105/8.1 |
| 2007/0131135 | A1 | 6/2007 | Moser et al. | |

FOREIGN PATENT DOCUMENTS

| | | |
|---|---|---|
| DE | 24 48 889 | 4/1975 |
| EP | 1 232 083 | 8/2002 |
| WO | WO 2005/042329 | 5/2005 |

OTHER PUBLICATIONS

International Search Report, corresponding to PCT/AT2005/000239, dated Oct. 21, 2005.

* cited by examiner

*Primary Examiner*—S. Joseph Morano
*Assistant Examiner*—Zachary Kuhfuss

(57) ABSTRACT

The invention relates to a convoy comprising at least two intercoupled rail vehicles between which an adapter is arranged, said adapter including at least two interconnectable sets of bellows which are respectively provided with a plurality of frames, in addition to adapter sheets , and a support for the adapter sheets, that can be displaced on a sliding plate arranged between the rail vehicles above a coupling device . At least one anti-catching device is provided on the intercoupled end regions of the rail vehicles , said anti-catching devices extending essentially over the entire width of the vehicle, and the two rail vehicle are intercoupled by a spiral sleeve. The sliding plate is embodied as three parts, part of the sliding plate arranged on the spiral sleeve being detachably connected to the coupling device.

16 Claims, 2 Drawing Sheets

COUPLING MUFF CONNECTION COMPRISING A THREE-PART ADAPTER SUPPORTING PLATE

CROSS-REFERENCE TO RELATED APPLICATIONS

This application is a U.S. National Phase Application of PCT Application No. PCT AT2005/000239, filed Jun. 28, 2005, which claims priority from Austrian Application No. A 1141/2004, filed Jul. 6, 2004.

FIELD OF THE INVENTION

The present invention pertains to a group of trains with at least two rail cars coupled to one another, between which is provided a bridge with at least two corrugated bellows that can be connected to one another and each having a plurality of bellows frames, and the bridge has, furthermore, bridge plates and a support for the bridge plates that is movable on a sliding plate arranged between the rail cars via a coupling means, wherein at least one anticlimber means each is provided on the end areas of the rails cars that are coupled to one another, and the anticlimber means each run essentially over the entire width of the car, the lower edges are arranged above the upper edges of the anticlimber means, and the sliding plate is arranged under the lower edge of the anticlimber means.

BACKGROUND OF THE INVENTION

In the case of a rear end collision between two rail cars, there is the risk that a box of one rail car is shifted over the other one with a height offset and causes considerable destruction in the passenger compartment. This risk exists not only for colliding front and end cars, but also for cars located in a group of trains. In order to prevent the risk of climbing, anticlimber means are usually installed. These anticlimber means, so-called "anticlimbers," are installed not only at the train ends, but also at the car ends, which are located within the group of trains.

A reliable meshing of two anticlimbers lying opposite one another can be guaranteed by means of the above-mentioned rail car in case of a collision even with a lateral offset of the colliding rail cars to one another.

A rail car of the type mentioned in the introduction has become known, e.g., from A 1735/2003. This rail car is schematically shown in FIG. 1 and shall be explained in detail below.

According to FIG. 1 the prior-art group of trains ZUV has at least two cars WA1, WA2, which are coupled to one another via a coupling KUP. Each of the two cars WA1, WA2 has an anticlimber means AC1, AC2, which is preferably made of steel, running essentially over the entire width of the car at a long-side end.

Between the rail cars WA1, WA2 is provided a bridge UEB, which has a fully closed corrugated bellows, which consists of at least two parts WB1, WB2: Namely, a first corrugated bellows WB1 assigned to the left car WA1 in the view and a second corrugated bellows WB2 assigned to the right car WA2 in the view. The corrugated bellows WB, WB2 may be connected to one another at their ends EN1, EN1 assigned to one another. To this end, each bellows WB1, WB2 may, for example, have a frame (not shown here) on the end side, wherein these frames can be bolted to one another or be connected via another coupling mechanism. Each of the corrugated bellows WB1, WB2 has bellows frames BR1, BR2, BR3, BR4 arranged in parallel to one another, which are preferably made of aluminum. These bellows frames BR1, BR2, is BR3, BR4 are indicated by broken lines in the view. One bellows frame BR1, BR2, BR3, BR4 each is located between two corrugations of the corrugated bellows WB1, WB2 in this case. The function of the bellows frames BR1, BR2, BR3, BR4 consists in maintaining the structure of the corrugated bellows and connecting the corrugations of the corrugated bellows to one another. The bellows frames BR1, BR2, BR3, BR4 are arranged such that the lower edges of the bellows frames BR1, BR2, BR3, BR4 come to lie above the upper edges of the anticlimber means AC1, AC2. Consequently, it is avoided that a meshing of the anticlimber means AC1, AC2 with one another by means of the bellows frames BR1, BR2, BR3, BR4 in case of a collision is prevented.

In order to make possible the arrangement of the bellows frames BR1, BR2, BR3, BR4 above the anticlimber means AC1, AC2, the lower edge of an end-side bellows frame BR1, BR4, which is placed on the box side, of each corrugated bellows WB1, WB2 is connected to the box WK1, WK2 via a profiled section arranged under the bottom area of the bridge and above the upper edge of the anticlimber means AC1, AC2 in front of a box WK1, WK2 of one of the rail cars WA1, WA2. The use of narrow profiled sections PR1, PR2 as screw-on frames in the horizontal bottom area of the bridge makes possible a simple mounting of the bridge UEB above the upper edge of the anticlimber AC1, AC2. The profiled sections PR1, PR2 may also be part of a frame that is mounted on the box WK1 or WK2.

In addition, bridge plates, so-called bridge plates, UB1, UB2, UB3, UB4, are provided in the bridge UEB, wherein every two bridge plates, designated as UB1, UB2, and designated below as "lateral bridge plates," are mounted rotatably at a profiled section WP1, WP2 of the respectively assigned box WK1, WK2, each about an axis A, A' running parallel to the rail plane and usually in the longitudinal direction of the car, wherein the bridge plates UB1, UB2, UB3, UB4 lie essentially at the level of the floor upper edges FN1, FN2.

In addition, the supporting structure of the front wall of each railroad car WA1, WA2 can be moved back in the longitudinal direction of the car to the end areas coupled to each other. Profiled sections WP1, WP2 made of a more readily deformable material are installed as the supporting structure of the front wall in the installation space that becomes free due to the moving back on both sides of an opening in the boxes WK1, WK2, by means of which a passenger may pass from one car WA1, WA2 into the other by means of the bridges UEB. As is evident from the drawing, the side bridge plates UB1, UB2 can be fastened at these profiled sections WP1, WP2 in the above-mentioned manner.

Due to the arrangement of profiled sections WP1, WP2 made of a more readily deformable material, for example, aluminum, as the supporting structure of the front wall, which can be made of steel, in a crash, a deformation of the softer profiled sections WP2, WP2 occurs, as a result of which the space needed for the block length of the bridge UEB is created.

A support ABS for a middle bridge plate or middle bridge plates UB3, UB4 is arranged above the coupling middle KPM of both rail cars WA1, WA2. The support ABS can be embodied in one part with the middle bridge plate at its upper area. The side bridge plates UB1, UB2 arranged respectively on the boxes WK1, WK2 lie on this bridge plate or bridge plates UB3, UB4. The free ends of the middle bridge plate or bridge plates UB3, UB4 may be beveled and lie under the side bridge plates UB1, UB2. Thus, the side bridge plates UB1, UB2 are supported on the middle bridge plates UB3, UB4 at their free ends. Due to the beveling of the free ends of the middle bridge plates UB3, UB4, an abutting surface is created for the side bridge plates UB1, UB2, as a result of which shiftings of the two cars WA1, WA2 in relation to one another can be compensated in the vertical and horizontal direction to one another.

The support ABS is movably arranged on a sliding plate GLP arranged above the coupling means KUP. The lower, solid section UAB of the support ABS, which cooperates with the sliding plate GLP, may be made of steel here, in order to improve the wear properties, as well as the slide plate support, to which the actual plastic sliding plate is fastened. According to the present invention, the sliding plate GLP and the lower section UAB of the support ABS are arranged under the lower edge of the anticlimber means AC1, AC2. Due to the arrangement of the sliding plate GLP as well as the base UAB of the support ABS cooperating with the sliding plate under the anticlimber means AC1, AC2, it can be avoided that a meshing with one another of the anticlimber means AC1, AC2 due to the sliding plate GLP or the base UAB of the support in a collision is prevented.

Furthermore, the support ABS may be made of aluminum in a vertical section MAB running essentially at right angles to the rail plane and located between the anticlimbers AC1, AC2 in an installed state. It is guaranteed by this embodiment that the anticlimber means AC1, AC2, in the case of a collision, can penetrate or deform the vertical, middle section MAB, which is made of aluminum, and thus mesh with one another.

In the above-described embodiment, the support of the bridge must be lowered as far as possible, i.e., the dimension between the sliding plate and the coupling longitudinal axis must be kept as small as possible.

The so-called clamp sleeve connection represents a very frequently used construction in a railroad car short coupling connection. It make it possible to produce a simple, safe and reliable connection of the two short coupling halves.

If the sliding plate now has a two-part design, wherein one part each of the sliding plate is rigidly arranged on each part of the coupling halves, then the sliding plate must be mounted at a height above the clamp sleeve connection that makes possible a raising of the upper clamp sleeve during the separation of the two rail cars to the extent that this no longer meshes with the clamp sleeve collar, and the connection can be separated.

However, in the bridge embodiment known from A 1735/2003, the distance between the sliding plate and the clamp sleeve needed for opening and closing the clamp sleeve cannot be met in a clamp sleeve connection, since, because of the design, a safe meshing of the anticlimbers lying with one another can consequently no longer be guaranteed.

BRIEF SUMMARY OF THE INVENTION

Therefore, the present invention overcomes the above-mentioned drawback.

This is accomplished according to the present invention in that the sliding plate has at least three plate-shaped parts, wherein a middle part of the sliding plate arranged above the clamp sleeve connection is detachably connected to the coupling means.

Since the middle part of the sliding plate is detachably connected to the coupling means, this can be removed before the separation of the coupling connection (opening of the clamp sleeve and raising of the upper clamp sleeve half). The space above the upper clamp sleeve half can thus be made free by removing the middle part of the sliding plate, as a result of which the upper clamp sleeve half can be raised.

The middle part of the sliding plate is advantageously bolted to the coupling means.

In a preferred embodiment of the present invention, a side part each of the sliding plate is arranged at each coupling half of the coupling means assigned to a rail car, wherein the side parts are advantageously rigidly connected to each coupling half assigned to them.

The present invention together with other advantages is explained in detail below on the basis of a few nonlimiting exemplary embodiments, which are shown in the drawings. In these drawings:

DETAILED DESCRIPTION OF THE INVENTION

Figure 1:
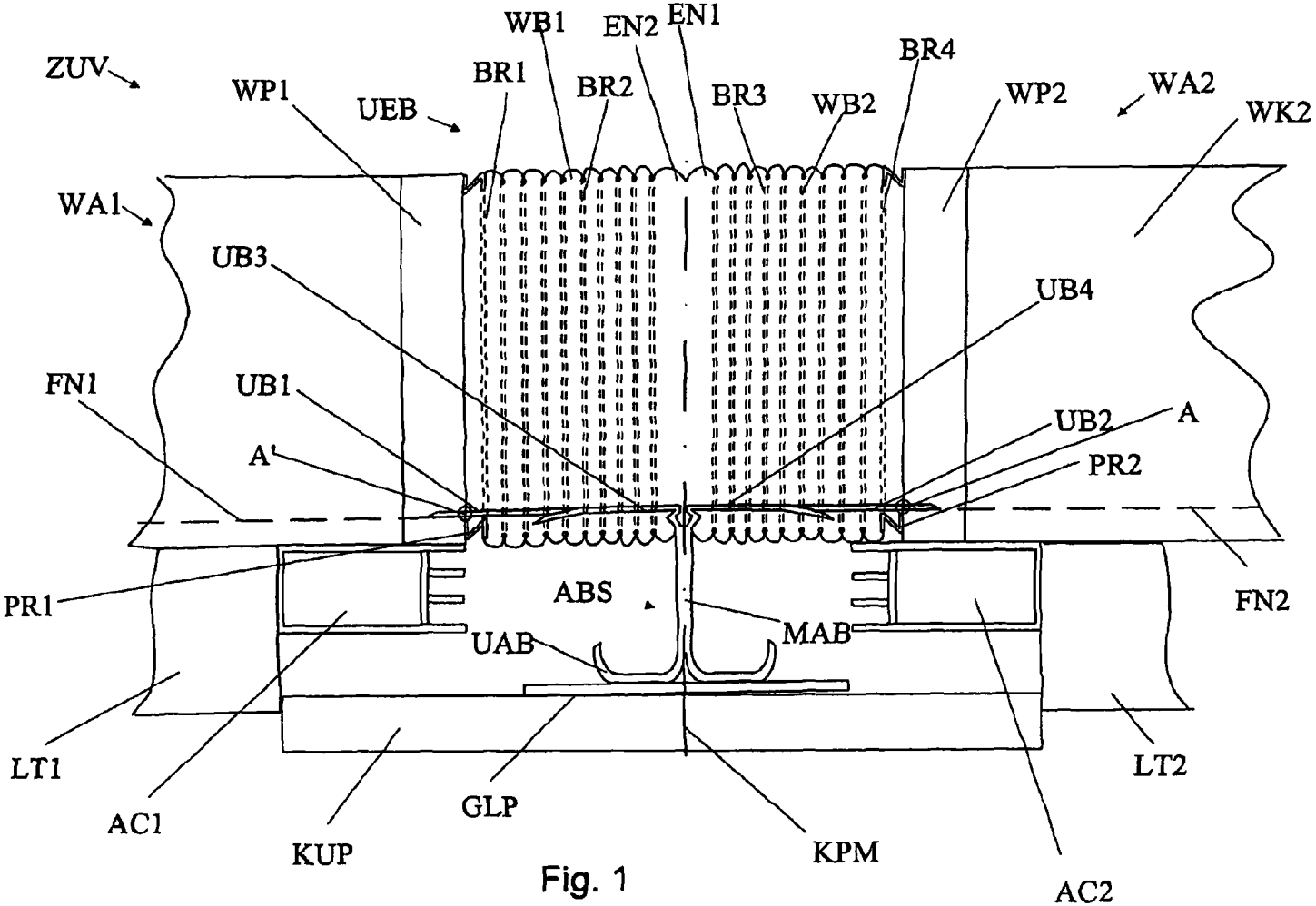
Fig. 1 PRIOR ART
FIG. 1 is a schematic drawing of a rail car coupling as known in the prior art.
Figure 2:
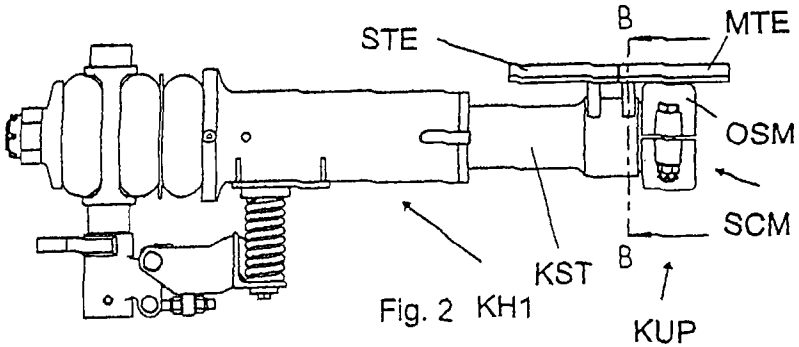
FIG. 2 schematically shows a lateral view of a short coupling half with a clamp sleeve and a sliding plate according to the present invention.

According to FIG. 2, a group of trains according to the present invention has a coupling means KUP consisting of two halves, wherein the two coupling halves are connected to one another via a clamp sleeve SCM. However, only one coupling half is shown in the present view.

The first coupling half KH1 shown here has a coupling rod KST, which is connected to the assigned rail car (not shown here). According to the present invention, the sliding plate GLP has at least three plate-shaped parts STE, MTE, wherein the third side part of the sliding plate GLP together with the associated second coupling half is not shown here.

The first side part STE of the sliding plate GLP is connected to the first coupling half KH1, wherein the part STE is connected preferably rigidly, i.e., essentially undetachably to the coupling half KH1. Of course, the side part STE may also be bolted to the coupling half KH1. The arrangement of the second side part (not shown) of the sliding plate GLP at the second coupling half corresponds to the arrangement of the first side part STE at the first coupling half KH1.

A middle part MTE of the sliding plate GLP is arranged directly above the clamp sleeve SCM. In order to make possible the arrangement of the middle part MTE above the clamp sleeve SCM, the middle part MTE is connected to each end section of the coupling half KH1 or the second coupling half (not shown here). The upper edges of the end sections lie, here, at least at the level of the upper edge of the upper part of the clamp sleeve connection (FIG. 5).

Figure 3:
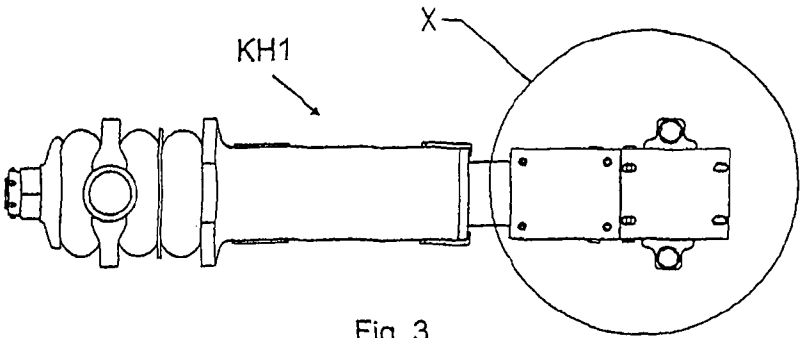
FIG. 3 schematically shows a top view of the short coupling half of FIG. 2.
Figure 4:
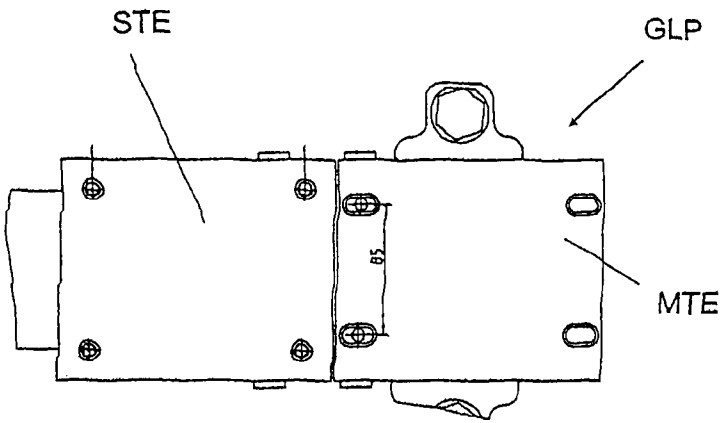
FIG. 4 schematically shows the area X of FIG. 3 in greater detail.

The three parts of the sliding plate GLP lie essentially in one plane, so that the surfaces of the three parts STE, MTE form a flat surface (FIG. 3, FIG. 4).

Figure 6:
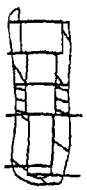
FIG. 6 schematically shows the area Y of FIG. 5
Figure 5:
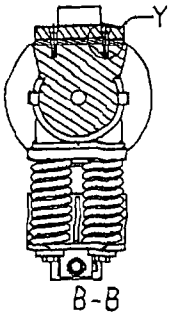
FIG. 5 schematically shows a section along the line B-B in FIG. 2.

To make possible a raising of the upper clamp sleeve OSM, the middle part MTE of the sliding plate GLP is detachably connected, and preferably bolted, to each coupling half KH1, wherein the bolt heads lie under the level of the surface of the sliding plate GLP, or end with the surface (FIG. 5, FIG. 6). By loosening the bolt connection, the middle part MTE can be removed in a simple manner, as a result of which enough space is available for raising the upper clamp sleeve OSM.

In conclusion, it should still be mentioned that, in the present document, the term rail car is defined not only as a drawn car, but also as a self-propelled car, even though this also does not represent the preferred embodiment of the present invention.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A group of trains with at least two rail cars, which are coupled to one another, between which is provided a bridge with at least two corrugated bellows, which can be connected to one another and each of which has a plurality of bellows frames, and the bridge has, furthermore, bridge plates and a support for the bridge plates that is movable on a sliding plate arranged between the rail cars via a coupling means, wherein at least one anticlimber means each is provided on the end areas of the rail cars that are coupled to one another, and the anticlimber means each run essentially over the entire width of the car, lower edges of the bellows frames being arranged above upper edges of the anticlimber means and the sliding plate is arranged under the lower edge of the anticlimber means wherein the two rail cars are coupled to one another by means of a clamp sleeve connection, and the sliding plate has at least three plate-shaped parts, wherein a middle part of the sliding plate arranged above the clamp sleeve connection is detachably connected to the coupling means.

2. The group of trains in accordance with claim 1, wherein the middle part of the sliding plate is bolted to the coupling means.

3. The group of trains in accordance with claim 1, wherein a lateral part of the sliding plate is arranged on each coupling half of the coupling means assigned to a rail car.

4. The group of trains in accordance with claim 1, wherein the lateral parts are rigidly connected to each coupling half assigned to them.

5. The group of trains in accordance with claim 1, wherein the middle part of the sliding plate is bolted to each end section of the coupling halves, wherein the upper edges of the end sections lie, in a mounted state, at least at the level of the upper edge of an upper clamp sleeve of the clamp sleeve connection.

6. The group of trains in accordance with claim 2, wherein a lateral part of the sliding plate is arranged on each coupling half of the coupling means assigned to a rail car.

7. The group of trains in accordance with claim 2, wherein the lateral parts are rigidly connected to each coupling half assigned to them.

8. The group of trains in accordance with claim 7, wherein the lateral parts are rigidly connected to each coupling half assigned to them.

9. The group of trains in accordance with claim 3, wherein the lateral parts are rigidly connected to each coupling half assigned to them.

10. The group of trains in accordance with claim 2, wherein the middle part of the sliding plate is bolted to each end section of the coupling halves, wherein the upper edges of the end sections lie, in a mounted state, at least at the level of the upper edge of an upper clamp sleeve of the clamp sleeve connection.

11. The group of trains in accordance with claim 3, wherein the middle part of the sliding plate is bolted to each end section of the coupling halves, wherein the upper edges of the end sections lie, in a mounted state, at least at the level of the upper edge of an upper clamp sleeve of the clamp sleeve connection.

12. The group of trains in accordance with claim 4, wherein the middle part of the sliding plate is bolted to each end section of the coupling halves, wherein the upper edges of the end sections lie, in a mounted state, at least at the level of the upper edge of an upper clamp sleeve of the clamp sleeve connection.

13. The group of trains in accordance with claim 6, wherein the middle part of the sliding plate is bolted to each end section of the coupling halves, wherein the upper edges of the end sections lie, in a mounted state, at least at the level of the upper edge of an upper clamp sleeve of the clamp sleeve connection.

14. The group of trains in accordance with claim 7, wherein the middle part of the sliding plate is bolted to each end section of the coupling halves, wherein the upper edges of the end sections lie, in a mounted state, at least at the level of the upper edge of an upper clamp sleeve of the clamp sleeve connection.

15. The group of trains in accordance with claim 8, wherein the middle part of the sliding plate is bolted to each end section of the coupling halves, wherein the upper edges of the end sections lie, in a mounted state, at least at the level of the upper edge of an upper clamp sleeve of the clamp sleeve connection.

16. The group of trains in accordance with claim 9, wherein the middle part of the sliding plate is bolted to each end section of the coupling halves, wherein the upper edges of the end sections lie, in a mounted state, at least at the level of the upper edge of an upper clamp sleeve of the clamp sleeve connection.

* * * * *